United States Patent [19]

Stokely

[11] 3,953,026

[45] Apr. 27, 1976

[54] ARM WRESTLING EXERCISE MACHINE

[76] Inventor: William R. Stokely, 5548 E. 46 St., Tulsa, Okla. 74135

[22] Filed: May 22, 1975

[21] Appl. No.: 580,052

[52] U.S. Cl. ..... 272/140

[51] Int. Cl.[2] ..... A63B 21/22

[58] Field of Search ..... 272/83, 82, 81, 79 R, 272/79 C, 57 D, 67

[56] References Cited

UNITED STATES PATENTS

| | | | |
|---|---|---|---|
| 319,686 | 6/1885 | Farmer | 272/83 R UX |
| 332,989 | 12/1885 | Benedict | 272/81 |
| 684,688 | 10/1901 | Herz | 272/81 |
| 929,281 | 7/1909 | Brodeur | 272/83 R UX |
| 2,219,219 | 10/1940 | Boger | 272/83 R |
| 2,782,033 | 2/1957 | Ugartechea | 272/67 |
| 2,783,044 | 2/1957 | Sbarra | 272/79 R |
| 3,495,824 | 2/1970 | Cuinier | 272/67 X |
| 3,563,542 | 2/1971 | Wellman et al. | 272/83 R |

FOREIGN PATENTS OR APPLICATIONS

| | | | |
|---|---|---|---|
| 238,720 | 10/1911 | Germany | 272/81 |
| 227 | 1/1902 | United Kingdom | 272/57 D |
| 405,617 | 4/1967 | Australia | 272/79 C |

*Primary Examiner*—Paul E. Shapiro
*Attorney, Agent, or Firm*—Head & Johnson

[57] ABSTRACT

An apparatus for practicing arm wrestling including an elongated rectangular frame, a shaft pivotally supported within the frame, an arm affixed to one end of the shaft and extending generally perpendicularly thereto, a shieve mounted on the shaft and rotated by rotation of the arm, a cable attached at one end to the periphery of the shieve, a spring secured to the frame and to the other end of the cable, a hand bar attached at the outer end of the arm and extending generally perpendicularly thereto such that as the arm is rotated about the shaft the shieve is rotated, winding the cable thereon and stretching the spring to impart a restraint on the rotation of the arm as a means of exercise experienced in arm wrestling.

7 Claims, 4 Drawing Figures

ARM WRESTLING EXERCISE MACHINE

BACKGROUND, SUMMARY AND OBJECTS OF THE INVENTION

A sport enjoyed by many people is that of arm wrestling. In recent years, the sport has increased in popularity. In arm wrestling two opponents face each other across a flat surface. The opponents then each position an elbow on the flat surface and clasp hands. The participant who can force the opponent's hand down against the surface prevails.

The present invention is directed towards an apparatus which can be used by an individual alone to practice arm wrestling. The device of the invention provides a frame having an arm extending therefrom, the arm simulating the arm of an opponent. The arm is pivoted and restrained in its movement by an extendable spring. As the arm is rotated in the direction in which a participant would attempt to rotate the arm of his opposer, restraint is applied by the spring so that the user is able to employ the same muscles acting in the same way as are utilized in actual arm wrestling. In this way, by repeated use, the user can exercise the muscles employed in arm wrestling and increase his effectiveness as a competitor.

It is therefore an object of this invention to provide an apparatus for practicing arm wrestling.

More particularly, an object of this invention is to provide an apparatus including apibotal arm simulating the arm of an opponent in arm wrestling, including means of applying restraint to the movement of the arm so that the user thereof can exercise the muscles employed in arm wrestling.

Still more particularly, an object of this invention is to provide an apparatus for use in practicing arm wrestling characterized by being light in weight and compact and therefore easily transportable by the user.

Still more particularly, an object of the invention is to provide an apparatus for practicing arm wrestling, the apparatus including a rectangular, elongated frame with side panels hinged to it in a way that the side panels can be used as a support for the elbow of the user and, when the apparatus is not in use, the side panels fold around the apparatus to enclose it in a compact package.

These general objects, as well as other and more specific objects of the invention will be fulfilled in the following in the following description and claims, taken in conjunction with the attached drawings.

DESCRIPTION OF THE VIEWS

DETAIL OF THE DESCRIPTION

Figure 1:
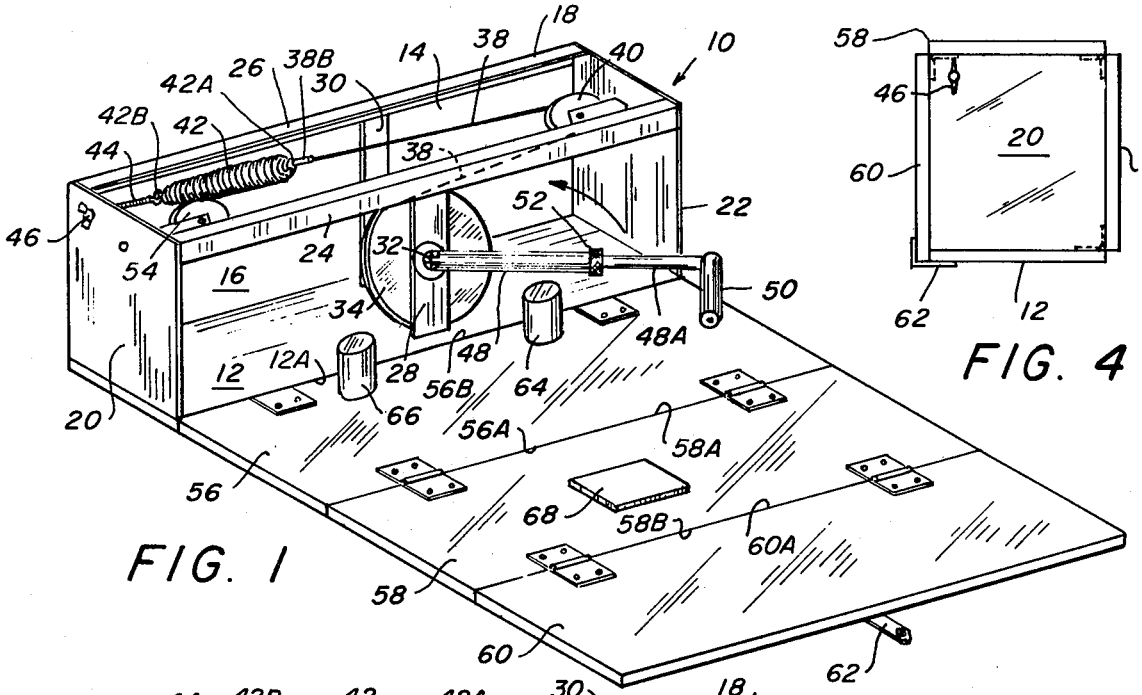
FIG. 1 is an isometric view of an apparatus employing the principles of this invention, the apparatus being shown when ready for use by a right-handed person.
Figure 2:
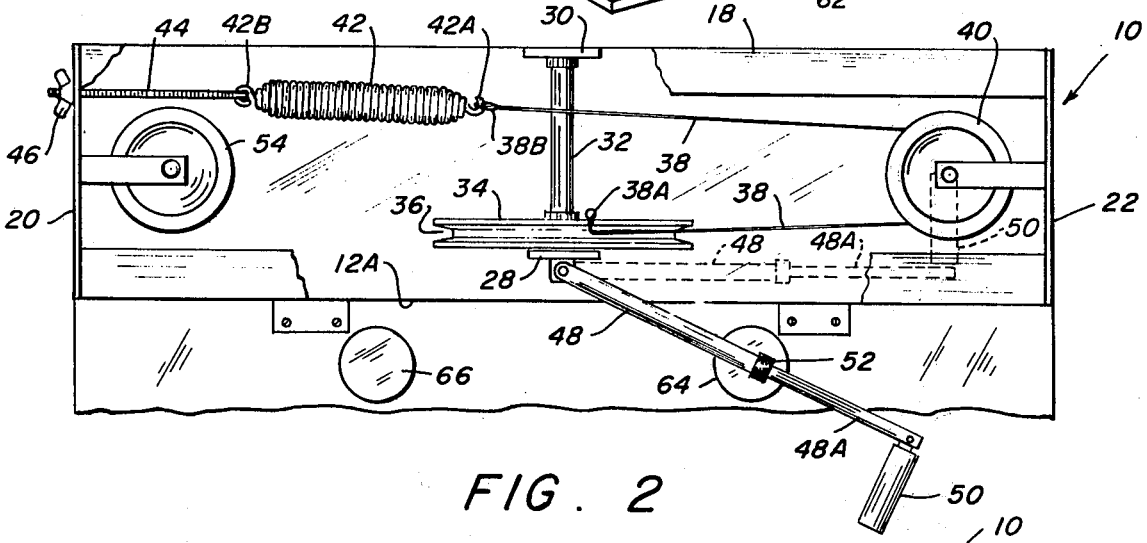
FIG. 2 is a partial top view of the device.
Figure 3:
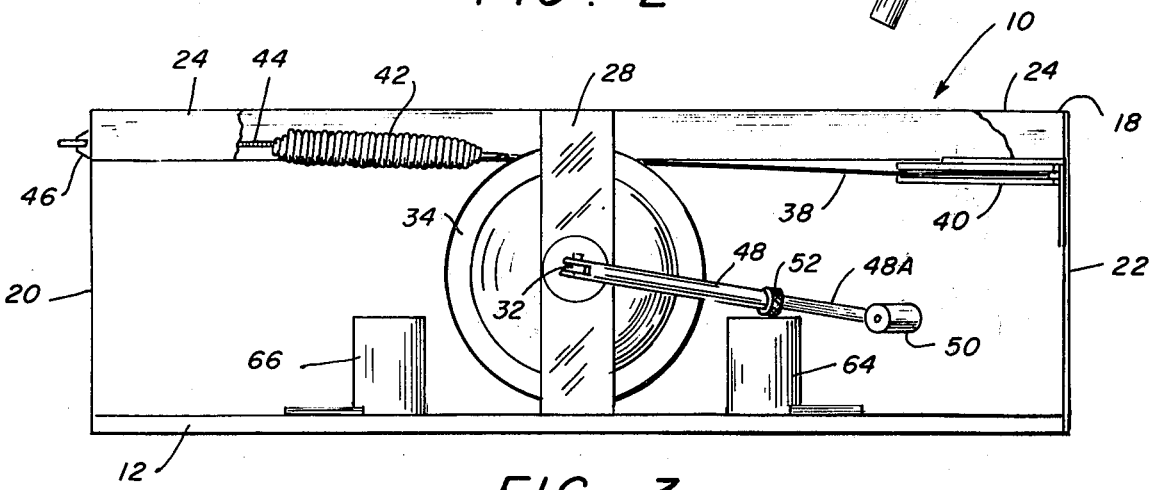
FIG. 3 is an elevational front view of the apparatus.

Referring to the drawings and first to FIGS. 1 and 2, the apparatus of the invention includes an elongated frame generally indicated by the numeral 10. The frame includes a bottom 12, a top 14, a front side 16, a back side 18, a left end 20 and a right end 22. The frame is generally open except for the bottom 12 and ends 20 and 22. The upper portion of the frame includes angular members 24 and 26 which extend from end 20 to end 22.

Positioned intermediate the ends 20 and 22, and extending from the bottom 12 is a front brace 28 which connects at the top with the angle member 24. Spaced from and parallel to it is a rear brace 30 which extends from bottom 12 to angular member 26.

Rotatably supported by the front brace 28 and the rear brace 30 is a shaft 32, the shaft being parallel to ends 20 and 22. Affixed to the shaft adjacent the front side 16 is a shieve 34. The shieve has a circumferential groove 36 therein. Attached to shieve 34 at the periphery is one end 38A of a cable 38. Secured to right end 22 is a pulley 40. Cable 38 loops around pulley 40 and the other end of the cable 38B is attached to one end 42A of an extendable spring 42. The other end of 42B of the spring is connected to a threaded bolt 44 which extends through an opening in the left end 20, the bolt receiving a wing nut 46. By tightening or loosening wing nut 46 the amount of tension applied by spring 42 on cable 38 can be adjusted.

Pivotally affixed to the forward end of shaft 32 is an arm 48. The arm 48 is affixed in a way so that it is pivotal in a plane of the shaft 32 but is nonpivotal in a plane perpendicular the shaft 32, so that as the arm 48 is rotated the shaft 32 and thereby shieve 34 is rotated to wind the cable 38 thereon and stretch spring 42.

At the outer end of arm 48 is a hand bar 50 which is pivoted to the arm, the hand bar being pivoted in a way so that it is movable in the plane of the arm 48 but nonmovable in the plane perpendicular to the arm. The hand bar 50 is grasped by the user of the device to rotate the arm 48.

In order to accomodate the apparatus for convenient use by people having different length arms, the arm 48 is preferably adjustable in length. This can be done in a variety of ways. In the illustrated arrangement the arm 48 includes an outer portion 48A which is telescopically received in portion 48. By means of a nut 52, threaded on the outer end of the arm portion 48, the total length of the arm may be easily adjusted.

The drawings show the apparatus arranged for use by a right handed person, that is, the arm 48 is restrained when moved counter-clockwise as would occur when a right handed person arm wrestles with a right handed opponent. Shieve 34 is rotated counter-clockwise winding the cable 38 thereon and stretching spring 42. In order to accomodate a left handed user, a second pulley 54 may be provided, affixed to left and wall 20. When the machine is rigged for a right handed person the pulley 54 is not utilized. However, to adapt the machine for use by a left handed person the cable 38 is looped through pulley 54 and back to spring 42 which is attached by means of the bolt 44 to the right hand end 22.

Figure 4:
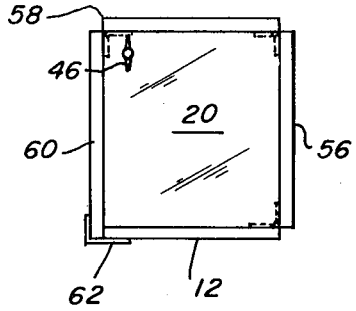
FIG. 4 is an end view of the device as it is closed for storage or transportation.

Hinged to the front edge 12A of frame bottom 12 is the rear edge 56B of a front panel 56. The front panel 56 is as long as the frame 10 and equal in height to the height of the frame. In like manner, hinged to the frong edge 56A of the front panel is the rear edge 58B of top panel 58. Finally, the first edge 60A of a rear panel 60 is hinged to the forward edge 58B of the top panel 58. Panels 56, 58 and 60 serve two purposes. First, when extended in the plane of the frame bottom 12 as shown in FIG. 1, they provide a flat surface upon which the user may rest his elbow. The second use is illustrated in FIG. 4. The panels 56, 58 and 60 fit around the frame and completely enclose it in a compact unit for easy storage and transportation. The panels may be held in the position shown by means of a strap 62 or other means of removably securing the folded panels to bottom panel 12.

To protect the knuckles and fingers of the user by preventing the hand bar 50 from striking front panel 56, stop members 64 and 66 are attached to the front panel 56 adjacent the rear edge 56B thereof. Arm 58 engages stop members 64 and 66 to prevent the hand bar 50 from contacting front panel. An elbow pad 68 is attached to the top panel 58.

When the device is in use for arm wrestling exercising the hand bar 50 is positioned as shown in the drawings. When the device is to be stored the hand bar 50 is rotated 180 degrees and the arm 48 moved in the position shown in dotted outline in FIG. 2. In this position the arm and hand bar are completely contained within the frame and the panels 56, 58, and 50 may be folded about the frame as shown in FIG. 4.

The device provides an inexpensive, light weight and easily transportable device for use by an individual to practice arm wrestling. It may be carried by travelers and vacationers for use in practicing arm wrestling without requiring stationary apparatus.

While the invention has been described with a certain degree of particularity it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled. As an example of an alternate embodiment, the exercise machine disclosed and claimed herein may be employed to exercise the triceps muscles of the user. That is, by extending the arm 48 upwardly amd pushing on the handle 50 with the triceps muscles the user can exercise these extensor muscles along the back of the arm. Other uses and arrangments can and likely will be made, all within keeping with the concepts of the invention.

I claim:

1. An apparatus for practicing arm wrestling, comprising:

an elongated frame having a bottom, a top, a front side, a rear side, a left end and a right end;

a shaft pivotally supported within the frame parallel and intermediate the frame ends and parallel and intermediate the top and bottom;

an arm affixed at one end to said shaft, the arm being pivotally secured to said shaft in the plane of said shaft and non-rotatable relative to said shaft in the plane perpendicular said shaft;

a sheave affixed to said shaft and rotated by rotation of said arm;

a cable having one end affixed to said sheave at the periphery whereby the cable is wound on said sheave by the movement of said arm;

an extension spring having one end attached to the other end of said cable, and the other end attached to said frame, and a hand bar pivotally attached to said arm outer and said hand bar being pivotal in the plane of said arm and nonpivotal in the plane perpendicular said arm, the said spring being stretched by the pivotation of said arm.

2. An apparatus for practicing arm wrestling according to claim 1 in which the length of said arm is adjustable.

3. An apparatus for practicing arm wrestling according to claim 1 in which the length of said shaft is not greater than the width of said frame between the front and rear sides, and wherein said hand bar may be pivoted 180° relative to said arm to extend in the direction towards said frame rear side, whereby said arm and hand bar may be folded within said frame.

4. An apparatus for practicing arm wrestling according to claim 1 including:

a front panel of a length equal said frame, the front panel being hinged along the rear edge to the front edge of said frame bottom.

5. An apparatus for practicing arm wrestling according to claim 4 including:

a stop member affixed to said front panel adjacent the edge hinged to said frame bottom, said stop member being positioned to be engaged by said arm as it is rotated downwardly towards said front panel to prevent said hand bar from contacting said front panel and thereby protect the fingers of the user of the apparatus.

6. An apparatus for practicing arm wrestling according to claim 4 whereby said front panel is equal in width to the height of said frame and including:

a top panel of length equal the length of said frame and of width equal the depth of said frame, the top panel being hinged along a first edge to the front edge of said front panel; and a rear panel of length equal to the length of said frame, and of width equal to the height of said frame, the rear panel being hinged at one edge to the other edge of said top panel, the front, top and side panels being arranged so that in one mode they lay flat in front of said frame and, in another mode, encompass and enclose said frame, and including means of releasably attaching said rear panel to the rear edge of said frame bottom.

7. An apparatus for practicing arm wrestling according to claim 1 wherein said spring is connected at one end to one of said frame ends, and including:

a pulley attached to the other of said frame ends, said cable looping around said pulley between said sheave and said spring whereby said spring is stretched from one said frame end towards said pulley at the other said frame end when said arm is rotated.

* * * * *